US009085847B2

(12) United States Patent
Lundt

(10) Patent No.: US 9,085,847 B2
(45) Date of Patent: Jul. 21, 2015

(54) METHOD AND A FEEDER FOR FEEDING PIECES OF CLOTH

(75) Inventor: Morten Engel Lundt, Ronne (DK)

(73) Assignee: JENSEN DENMARK A/S, Ronne (DK)

( * ) Notice: Subject to any disclaimer, the term of this patent is extended or adjusted under 35 U.S.C. 154(b) by 0 days.

(21) Appl. No.: 14/122,386

(22) PCT Filed: May 25, 2012

(86) PCT No.: PCT/DK2012/050179

§ 371 (c)(1),
(2), (4) Date: Dec. 17, 2013

(87) PCT Pub. No.: WO2012/163356

PCT Pub. Date: Dec. 6, 2012

(65) Prior Publication Data

US 2014/0096421 A1 Apr. 10, 2014

(30) Foreign Application Priority Data

May 27, 2011 (DK) ..... 2011 70263

(51) Int. Cl.
*D06F 67/04* (2006.01)
*D06F 67/02* (2006.01)
*D06F 69/00* (2006.01)

(52) U.S. Cl.
CPC ..... *D06F 67/04* (2013.01)

(58) Field of Classification Search
CPC ..... D06F 67/02; D06F 67/04; D06F 60/00; D06F 60/02
USPC ..... 38/143; 271/176, 189
See application file for complete search history.

(56) References Cited

U.S. PATENT DOCUMENTS

| | | | | |
|---|---|---|---|---|
| 2,635,370 | A | 4/1953 | Mann, Jr. et al. | |
| 3,370,849 | A * | 2/1968 | Martin | 271/176 |
| 3,442,036 | A | 5/1969 | Taylor | |
| 4,345,391 | A | 8/1982 | Weir | |
| 4,437,247 | A | 3/1984 | Wiebesiek | |
| 4,979,868 | A | 12/1990 | Ueda et al. | |
| 5,168,645 | A | 12/1992 | Robin et al. | |
| 5,169,282 | A | 12/1992 | Ueda et al. | |
| 5,172,502 | A | 12/1992 | Kober | |
| 5,349,768 | A * | 9/1994 | Ishihara et al. | 38/143 |
| 5,416,992 | A | 5/1995 | Ueda et al. | |

(Continued)

FOREIGN PATENT DOCUMENTS

| | | | |
|---|---|---|---|
| DE | 30 20 428 | A1 | 12/1981 |
| DE | 38 25 646 | A1 | 2/1990 |

(Continued)

OTHER PUBLICATIONS

International Search Report issued by the European Patent Office in coresponding International Application No. PCT/DK2012/050179, mailed Nov. 5, 2012, 2 pages.

*Primary Examiner* — Ismael Izaguirre
(74) *Attorney, Agent, or Firm* — Finnegan Henderson Farabow Garrett & Dunner LLP

(57) ABSTRACT

The feeder comprises a spreader device 4, 5 that is configured for seizing two adjacent corners of a piece of laundry and for subsequently shifting the two adjacent corners away from each other, to the effect that a first side edge of the piece of laundry, which side edge is situated between the two adjacent corners, is straightened. By use of two conveyors 6, 11 for advancing the piece of laundry it is enabled that the piece of cloth is turned between the two conveyors whereby a higher productivity is obtained by use of the feeder due to it being necessary to reject fewer pieces of laundry due to misaligned introduction of the pieces of laundry into the feeder.

8 Claims, 2 Drawing Sheets

(56) References Cited

U.S. PATENT DOCUMENTS

| | | | | |
|---|---|---|---|---|
| 5,440,810 | A | 8/1995 | Borucki et al. | |
| 5,515,627 | A | 5/1996 | McCabe | |
| 5,606,812 | A * | 3/1997 | Jensen | 38/143 |
| 6,477,797 | B1 | 11/2002 | Takahashi et al. | |
| 6,618,968 | B1 * | 9/2003 | Nielsen | 38/143 |
| 8,028,444 | B2 * | 10/2011 | Heinz et al. | 38/143 |

FOREIGN PATENT DOCUMENTS

| | | | |
|---|---|---|---|
| DE | 10 2005 024 801 | A1 | 11/2006 |
| DK | 175455 | B1 | 11/2004 |
| EP | 0 666 360 | A1 | 8/1995 |
| EP | 0 567 046 | B1 | 9/1998 |
| EP | 0567046 | T3 | 2/1999 |
| EP | 0 791 094 | B1 | 5/2000 |
| EP | 0 791 094 | T3 | 7/2000 |
| EP | 1 198 634 | B1 | 7/2004 |
| GB | 2 081 749 | A | 2/1982 |
| GB | 2 221 226 | A | 1/1990 |
| JP | 2011-001178 | A2 | 1/2011 |
| WO | WO 9603540 | A2 | 2/1996 |

* cited by examiner

METHOD AND A FEEDER FOR FEEDING PIECES OF CLOTH

FIELD OF APPLICATION OF THE INVENTION

The present invention relates to a method and a feeder for feeding substantially rectangular pieces of laundry into a cloth treatment apparatus, such as a rotary ironer, said feeder comprising a spreader device configured for seizing two adjacent corners of a piece of laundry and for subsequently shifting the two adjacent corners away from each other to the effect that a first side edge of the piece of laundry, said side edge being located between the two adjacent corners, is straightened, and wherein the feeder further comprises a transfer conveyor configured for transporting the piece of laundry to the spreader device with the first side edge of the piece of laundry being substantially at the back relative to the direction of conveyance of the transfer conveyor, said transfer conveyor having an exit end disposed at the spreader device and an entry end disposed at a distance there from, and wherein the transfer conveyor is configured such that, during the transport between the entry and exit ends of the transfer conveyor, the piece of laundry is capable of being suspended down to each side of the transfer conveyor, and such that the transfer conveyor pulls each of the sides of the piece of laundry that are suspended down from the transfer conveyor across a support arranged at the spreader device, and underneath or to each side of the transfer conveyor, in such a manner that the two adjacent corners of the piece of laundry are pulled last across the support following which the spreader device is capable of seizing the two adjacent corners.

STATE OF THE ART

A feeder of the kind mentioned above is known from U.S. Pat. No. 5,515,627.

A piece of laundry being secured, in such feeder, at the adjacent corners at the rearmost edge of the piece of laundry, and in such a manner that the piece of laundry is suspended down from those corners, it is easy to subsequently position the piece of laundry on eg a feeder conveyor which has, substantially, a transport face permitting the piece of laundry to be completely or partially straightened on the feeder conveyor.

By the technique said forth according to the above mentioned U.S. Pat. No. 5,515,627 an increased productivity is thus achieved since an operator having the task of taking out individual pieces of laundry from a pile and subsequently placing that piece of laundry in the feeder does not have to retrieve the two adjacent corners; rather he/she merely has to find a side edge of the piece of laundry and arrange that side edge in the transfer conveyor of the feeder.

OBJECT OF THE INVENTION

Based on this, it is the purpose of the present invention to provide a feeder whereby, all other things being equal, a possibility is provided of accomplishing an even higher productivity.

This is achieved by a feeder of the kind set forth in the introductory part which is characterised in further comprising a feeder conveyor having an exit end arranged at the entry end of the transfer conveyor, and an entry end arranged at a distance there from, and wherein, between the exit end of the entry conveyor and the entry end of the transfer conveyor, there is a distance permitting a piece of laundry to be suspended from the exit end of the entry conveyor between the exit end of the entry conveyor and the entry end of the transfer conveyor, and with the first side edge at the bottom, and a transfer device being configured for transferring the side edge of the piece of cloth which is opposite to the first side edge to the entry end of the transfer conveyor.

By a preferred embodiment of the invention, the transfer conveyor and the entry conveyor are arranged in extension of one another.

Additionally, the transfer conveyor and the entry conveyor, respectively, may advantageously each comprise a belt conveyor above which means are configured for abutting on the surface of each of the belt conveyors at least at the entry and exit ends of the transfer conveyor and the entry conveyor.

According to a further preferred embodiment, a feeder according to the invention may further comprise means for actively pushing or pressing a part of the piece of laundry away from the exit end of the entry conveyor and towards the transfer conveyor's entry end, and those means for pushing or pressing a part of the piece of laundry may advantageously comprise one or more air nozzles that are configured for emitting a jet of pressurized air towards the piece of laundry, said nozzles being arranged at the exit end of the entry conveyor and are directed towards the entry end of the transfer conveyor.

In the context of this, it is a further advantage if, at the entry conveyor, a sensor is provided for registering that the side edge which is opposite to the first side edge of the piece of laundry passes by the sensor, and means for essentially simultaneously activating the transfer device when the sensor registers that the opposite side edge passes by the sensor.

Efficient and reliable transfer of the piece of laundry is achieved if the entry end of the transfer conveyor is arranged in level with or lower than the exit end of the entry conveyor.

The invention furthermore relates to a method by which a further increase in the productivity is accomplished by use of a method for feeding the substantially rectangular pieces of laundry into a cloth processing apparatus, such as a rotary ironer, which method comprises that two adjacent corners at a first side edge of the piece of laundry are seized by a spreader device configured therefor on a feeder, following which the two adjacent corners are spread from one another until the first side edge of the piece of cloth is essentially straightened, and wherein the piece of laundry in the feeder is advanced to the spreader device by means of a transfer conveyor conveying the piece of laundry with the first side edge of the piece of cloth essentially at the back in the direction of conveyance of the transfer conveyor and with the two side edges of the piece of cloth that are adjacent relative to the first side edge suspended down to each side of the transfer conveyor, and wherein the two adjacent side edges of the piece of cloth are pulled across a support which is arranged at the spreader device and underneath or to each side of the transfer conveyor in such a manner that the two adjacent corners of the piece of laundry are pulled last across the support, following which the spreader device is capable of seizing the two adjacent corners.

In accordance with the invention, the piece of laundry is advanced in a direction towards the transfer conveyor by means of an entry conveyor in which the piece of laundry is advanced by the entry conveyor with the first side edge substantially at the front in the direction of conveyance of the entry conveyor, and following which the piece of laundry is caused to be suspended down between the entry conveyor and the transfer conveyor with its first side edge substantially at the bottom, following which it is, relative to the side edge of the piece of laundry which is opposite to the first side edge, transferred from the entry conveyor to the transfer conveyor which subsequently advances the piece of laundry with the side edge which is opposite to the first side edge in front of the first side edge, seen in the direction of conveyance of the transfer conveyor.

According to a preferred embodiment of the method according to the present invention, the piece of cloth is suspended, at a point in time, down between the entry conveyor and the transfer conveyor with its first side edge substantially at the bottom, and with the side edge which is opposite the first side edge substantially at the top, and the side edge which is opposite to the first side edge, is transferred to the transfer conveyor by means of a jet of pressurized air which is directed from the entry conveyor and in a direction towards the transfer conveyor. This can be done in a particularly reliable manner before the opposite side edge has let go of the entry conveyor, but it is also possible to do so albeit the piece of cloth is, in that situation, freely suspended in the air.

In this context, a further increased productivity is accomplished if the side edge of the piece of laundry which is opposite to the first side edge is transferred to the transfer conveyor with a fold at the front in the direction of conveyance.

LIST OF FIGURES

EMBODIMENT OF THE INVENTION

Figure 1:
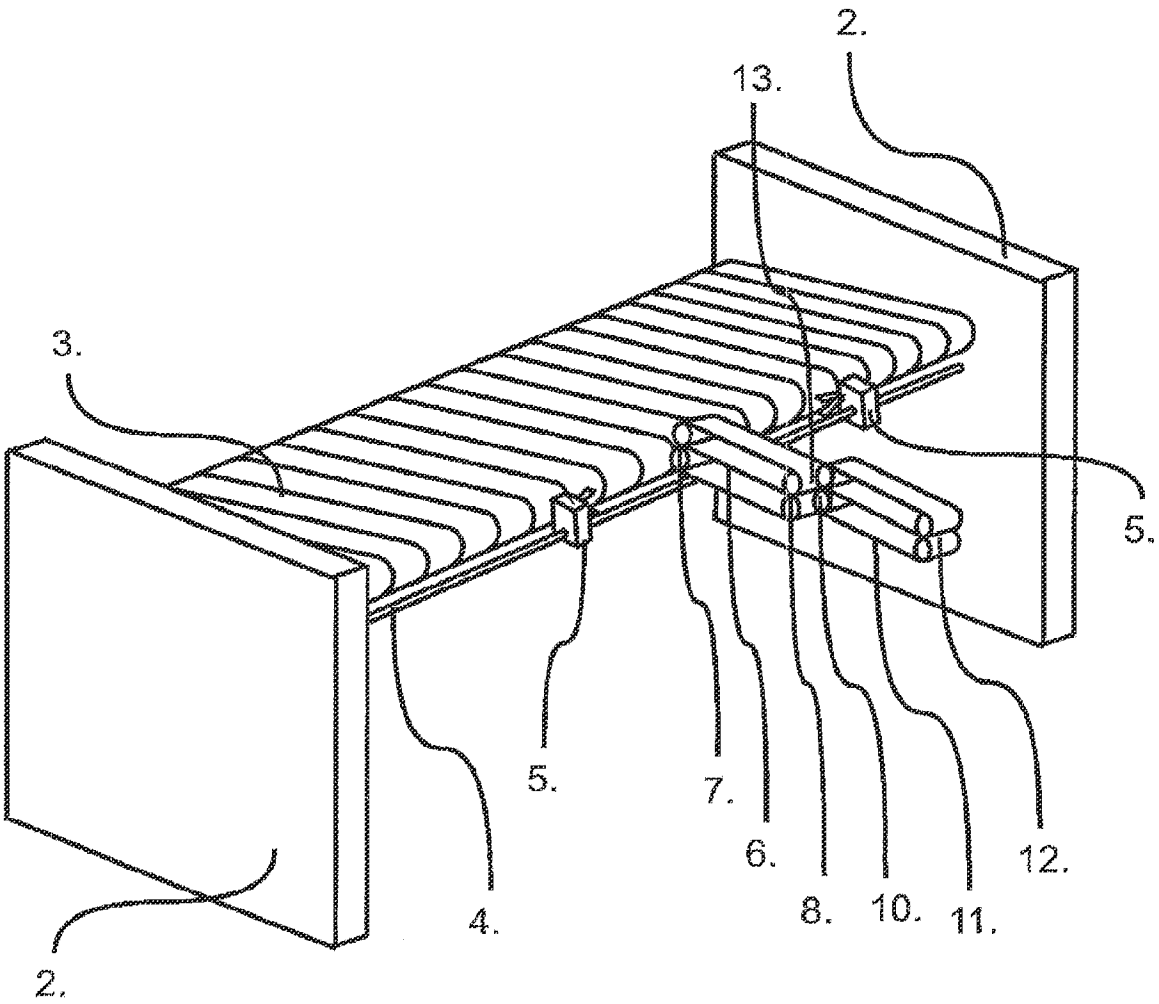
FIG. 1 is a sketch showing a feeder according to the invention, seen in an inclined view from above.
Figure 2:
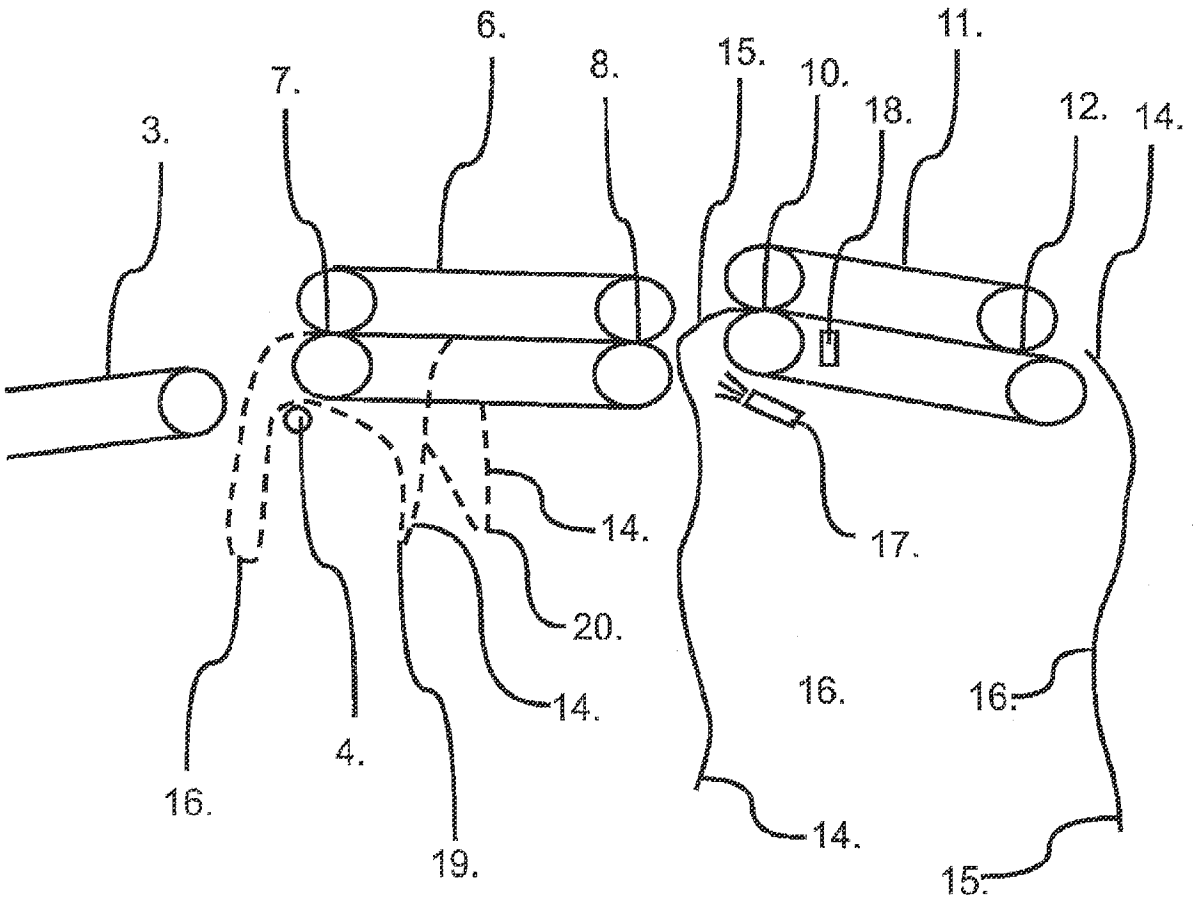
FIG. 2 is an explanatory sketch showing various process steps by the method according to the invention while using the feeder shown in FIG. 1.

Thus, FIG. 1 shows the principles of construction of a feeder 1 according to the present invention, and FIG. 2 shows various locations of pieces of laundry in various process steps in accordance with the invention; and, in the following, the feeder and the process steps it is intended to perform are described with reference to those figures.

Thus, the feeder 1 comprises a frame structure 2 in which a feeder conveyor 3 is configured that consists of a number of conveyor belts mounted on one and the same set of conveyor rollers, and wherein, in front of the feeder conveyor 3, a spreader device is configured comprising a rail 4 on which two grippers 5 are accommodated that are both connected to a motor (not shown) which may cause the two grippers 5 to be shifted away from each other and towards each other, respectively, along the rail 4 to the effect that they are capable of spreading a piece of laundry 16 (shown in FIG. 2) having two adjacent corners secured at the one and the other gripper 5, respectively.

Above the rail 4, a transfer conveyor 6 is configured that consists of two belt conveyors that are arranged in abutment on each other whereby they form a sandwich conveyor. That transfer conveyor 6 has an exit end 7 arranged above the rail 4 and close to the feeder conveyor 3, and an entry end 8 arranged at a distance from the feeder conveyor, and thus, the transfer conveyor 6 is arranged to advance a piece of laundry 16 towards and across the rail 4 to the effect that the piece of laundry 16 is pulled across the rail 4 when it is conveyed out of the exit end 7.

The width of the transfer conveyor 6 being substantially smaller than the side lengths of the piece of laundry 16, the piece of laundry 16 will, with a high degree of probability, be advanced, in this transfer process, with a major part of the piece of laundry 16 suspended down to each side of the transfer conveyor 6, and this will mean that two adjacent corners of the piece of laundry 16 between which a first side edge 14 of the piece of laundry 16 extends, will thus, with a high degree of probability, become the last part of the piece of laundry 16 that is pulled across the rail in that process, and thereby the grippers 5 can be configured to seize those corners by use of known means which it will natural to point to by the person skilled in the art on the basis of the description set forth above.

According to the invention there is, in front of the transfer conveyor 6, further arranged an entry conveyor 11 which, like the transfer conveyor 6, comprises two belt conveyors that abut on each other and thus form a sandwich conveyor.

This entry conveyor 11 is thus configured to advance a piece of laundry 16 forwards in a direction towards the transfer conveyor 6 in the same manner as the transfer conveyor 6 advances the piece of laundry 16 in a direction towards the feeder conveyor 3, but yet with the first side edge 14 in front of the opposed side edge 15.

However, there being provided a certain space 13 between the entry conveyor 11 and the transfer conveyor 6, the piece of laundry will 16 not, as a matter of course, be seized by the transfer conveyor 6, rather it will, when it is conveyed out through the exit end 10 on the entry conveyor 11, start to become suspended down between the transfer conveyor 6 and the entry conveyor 11 with the first side edge 14 at the bottom.

To transfer the side edge 15 which is opposite relative to the first side edge 14 of the piece of laundry 16 for introduction into the entry end 8 of the transfer conveyor 6 there is, as shown in FIG. 2, configured an air nozzle 17 and a sensor 18 that is configured with a control (not shown) which brings about, when the opposite side edge 15 of the piece of laundry 16 passes by the sensor 18, that the air nozzle 17 is activated to simultaneously or with a short delay send a jet of pressurized air towards the end of the piece of laundry 16 close to the opposed side edge 15 to the effect that the opposed side edge is pushed by the air pressure into the nip in the entry end of the transfer conveyor 6, following which the piece of laundry is conveyed with the opposed side edge 15 in front of the first side edge 14.

In this way the piece of laundry 16 has been turned around and thereby a certain degree of straightening of the piece of laundry 16 is obtained if it is introduced more or less misaligned into the entry conveyor 11, and thereby there is an increased probability that several pieces of laundry 16 can be seized correctly by means of the grippers 5 which, in turn, entails an increased productivity by use of the feeder.

Simultaneously herewith it is ensured that, more often, the piece of laundry 16 will be completely unfolded following the process in the feeder as it is turned and simultaneously braked and accelerated in the area between the transfer conveyor 6 and the entry conveyor 11, which will, once again, entails an increased productivity, all other things being equal.

This is illustrated most clearly in FIG. 2, wherein a piece of laundry 16 is shown in the three most important process steps according to the invention, viz before the piece of laundry is introduced into the entry conveyor 11 with the first side edge 14 in front of the opposed side edge 15, and in the next position wherein the piece of laundry 16 is advanced completely through the entry conveyor 11 and is disposed essentially freely suspended down between that and the transfer conveyor 6 as set forth above, and whereby the piece of laundry is turned around to the effect that it is subsequently transferred to the transfer conveyor 6 and is subsequently advanced with its first side edge 14 behind the opposed side edge 15.

Thereby the piece of laundry is pulled across the support which, in the shown embodiment, is constituted by the rail 4, to the effect that the grippers 5 are capable of seizing the two adjacent corners 19, 20 at the first side edge 14 of the piece of laundry, and then they are capable of transferring the piece of laundry 16 essentially in completely unfolded state to the feeder conveyor 3.

The invention claimed is:

1. A feeder for feeding substantially rectangular pieces of laundry into a cloth treatment apparatus, said feeder comprising a spreader device configured for seizing two adjacent corners of a piece of laundry and for subsequently shifting the two adjacent corners away from each other to the effect that a first side edge of the piece of laundry, said side edge being located between the two adjacent corners, is straightened; and wherein the feeder further comprises a transfer conveyor configured for transporting the piece of laundry to the spreader device with the first side edge of the piece of laundry being substantially at the back relative to the direction of conveyance of the transfer conveyor, said transfer conveyor having an exit end disposed at the spreader device and an entry end disposed at a distance there from; and wherein the transfer conveyor is configured such that, during the transport between the entry and exit ends of the transfer conveyor, the piece of laundry is capable of being suspended down to each side of the transfer conveyor, and such that the transfer conveyor pulls each of the sides of the piece of laundry that are suspended down from the transfer conveyor across a support arranged at the spreader device, and underneath or to each side of the transfer conveyor, in such a manner that the two adjacent corners of the piece of laundry are pulled last across the support following which the spreader device is capable of seizing the two adjacent corners, characterised in that the feeder further comprises an entry conveyor having an exit end arranged at the entry end of the transfer conveyor, and an entry end arranged at a distance there from, and wherein, between the exit end of the entry conveyor and the entry end of the transfer conveyor, there is a distance permitting the piece of laundry to be suspended down from the exit end of the entry conveyor between the exit end of the entry conveyor and the entry end of the transfer conveyor, and with the first side edge at the bottom, and a transfer device being configured for transferring the side edge of the piece of cloth which is opposite to the first side edge to the entry of the transfer conveyor, said transfer device comprising means for actively pushing or pressing a part of the piece of laundry away from the exit end of the entry conveyor and towards the entry end of the transfer conveyor, said means comprising one or more air nozzles that are configured for emitting a jet of pressurized air towards the piece of laundry, said nozzles being arranged at the exit end of the entry conveyor and are directed towards the entry end of the transfer conveyor, said transfer device comprising means for actively pushing or pressing a part of the piece of laundry away from the exit end of the entry conveyor and towards the entry end of the transfer conveyor, said transfer device comprising means for actively pushing or pressing a part of the piece of laundry away from the exit end of the entry conveyor and towards the entry end of the transfer conveyor, said means comprising one or more air nozzles that are configured for emitting a jet of pressurized air towards the piece of laundry, said nozzles being arranged at the exit end of the entry conveyor and are directed towards the entry end of the transfer conveyor.

2. A feeder according to claim 1, characterised in that the transfer conveyor and the entry conveyor are arranged in extension of one another.

3. A feeder according to claim 1 or 2, characterised in that the transfer conveyor and the entry conveyor, respectively, each comprises a belt conveyor above which means are configured for abutting on the surface of each of the belt conveyors at least at the entry and exit ends of the transfer conveyor and the entry conveyor.

4. A feeder according to claim 1 or 2, characterised in that, at the exit end of the entry conveyor, a sensor is provided for registering that the side edge which is opposite to the first side edge of the piece of laundry passes by the sensor, and means for essentially simultaneously activating the transfer device when the sensor registers that the opposite side edge passes by the sensor.

5. A feeder according to claim 1 or 2, characterised in that the entry end of the transfer conveyor is arranged in level with or lower than the exit end of the entry conveyor.

6. A method for feeding substantially rectangular pieces of laundry into a cloth processing apparatus, which method comprises that two adjacent corners at a first side edge of the piece of laundry are seized by a spreader device configured therefor on a feeder, following which the two adjacent corners are spread from one another until the first side edge of the piece of cloth is essentially straightened, and wherein the piece of laundry in the feeder is advanced to the spreader device by means of a transfer conveyor conveying the piece of laundry with the first side edge of the piece of cloth essentially at the back in the direction of conveyance of the transfer conveyor and with the two side edges of the piece of cloth that are adjacent relative to the first side edge suspended down to each side of the transfer conveyor, and wherein the two adjacent side edges of the piece of cloth are pulled across a support which is arranged at the spreader device and underneath or to each side of the transfer conveyor in such a manner that the two adjacent corners of the piece of laundry are pulled last across the support, following which the spreader device is capable of seizing the two adjacent corners, characterised in that the piece of laundry is advanced in a direction towards the transfer conveyor by means of an entry conveyor wherein the piece of laundry is advanced by the entry conveyor with the first side edge substantially at the front in the direction of conveyance of the entry conveyor, and following which the piece of laundry is caused to be suspended down between the entry conveyor and the transfer conveyor with its first side edge substantially at the bottom, following which it is, relative to the side edge of the piece of laundry which is opposite to the first side edge, transferred from the entry conveyor to the transfer conveyor which subsequently advances the piece of laundry with the side edge which is opposite to the first side edge in front of the first side edge, seen in the direction of conveyance of the transfer conveyor.

7. A method according to claim 6, characterised in that the piece of cloth is suspended, at a point in time, down between the entry conveyor and the transfer conveyor with its first side edge substantially at the bottom, and with the side edge which is opposite the first side edge substantially at the top; and in that the side edge which is opposite to the first side edge, is transferred to the transfer conveyor by means of a jet of pressurized air which is directed from the entry conveyor and in a direction towards the transfer conveyor.

8. The feeder of claim 1, said treatment apparatus being a rotary ironer.

* * * * *